US006298901B1

(12) United States Patent
Sakamoto et al.

(10) Patent No.: US 6,298,901 B1
(45) Date of Patent: Oct. 9, 2001

(54) METHOD AND APPARATUS FOR SEMI-MOLTEN METAL INJECTION MOLDING

(75) Inventors: Kazuo Sakamoto; Kyoso Ishida; Yukio Yamamoto, all of Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/345,488

(22) Filed: Jul. 1, 1999

(30) Foreign Application Priority Data

Jul. 3, 1998 (JP) ..... 10-204337

(51) Int. Cl.[7] ..... B22D 27/09
(52) U.S. Cl. ..... 164/113; 164/900
(58) Field of Search ..... 164/900, 113, 164/312, 120

(56) References Cited

U.S. PATENT DOCUMENTS

| | | | | |
|---|---|---|---|---|
| 4,694,882 | | 9/1987 | Busk . | |
| 4,798,237 | * | 1/1989 | Nakamo | 164/255 |
| 5,531,261 | * | 7/1996 | Yoshida et al. | 164/113 |
| 5,693,158 | * | 12/1997 | Yamamoto et al. | 148/557 |

FOREIGN PATENT DOCUMENTS

| | | |
|---|---|---|
| 0572683 A1 | 1/1993 | (EP) . |
| 0701002 A1 | 3/1995 | (EP) . |
| 0710515 A1 | 6/1995 | (EP) . |
| 62279061 | 3/1987 | (JP) . |
| 2-15620 | 4/1990 | (JP) . |

* cited by examiner

*Primary Examiner*—Tom Dunn
*Assistant Examiner*—Len Tran
(74) *Attorney, Agent, or Firm*—Nixon Peabody LLP; Donald R. Studebaker

(57) ABSTRACT

In a semi-molten metal injection molding method of producing a thick molded article by injecting a semi-molten melt M of a magnesium alloy, in a semi-melting state, into a cavity 13 of a mold 11 through a product gate 17, characterized in that it is made possible to obtain a high-quality thick molded article free from internal defects. A solid fraction of the semi-molten melt M is set to not less than 10%, and more preferably within a range of 40 to 80%. A sectional area Sg of a product gate portion of the thick molded article corresponding to the product gate 17 is set to not less than 0.1 times a sectional area Sp in the vicinity of the product gate 17 in the product portion corresponding to the cavity 13. Furthermore, a product gate velocity Vg mm/s of the semi-molten melt M, a sectional area Sg $mm^2$ of the product gate portion of the thick molded article and a volume Vp $mm^3$ of the product portion are set so as to satisfy the following relationships: $Vg \leqq 8.0 \times 10^4$; and, $Vg \times Sg / Vp \geqq 10$.

5 Claims, 8 Drawing Sheets

300 μm

300 μm

300 μm

METHOD AND APPARATUS FOR SEMI-MOLTEN METAL INJECTION MOLDING

BACKGROUND OF THE INVENTION

1. Field of the Invention

The present invention relates to a method and an apparatus for injection molding a semi-molten metal into a mold cavity to produce a thick molded article 2. Prior Art As a method of producing a metal molded article having better internal quality than that made by die-casting, a semi-molten metal injection molding method wherein a molten metal (magnesium alloy), in a semi-melting state at a temperature of not more than a liquidus temperature of the metal material, is injected into a cavity of a mold has conventionally been known, as disclosed in Japanese Patent Publication JP-B2-15620 (1990), corresponding to U.S. Pat. No. 4694882. Since the method for injection molding a semi-molten metal makes it possible to mold the metal at a relatively low temperature, the useful life of molds can be made longer than that of a mold used in die-casting, and moreover the high molding accuracy can be maintained for a long time of repeated moldings.

When molding a thick-wall metallic article having a thickness of not less than 5.0 mm in a product portion corresponding to a cavity by injection molding, a die casting method is apt to cause disturbance in the molten metal flow, during filling the cavity with the molten metal, which leads to gas entrapment and lower internal quality. Therefore, the injection molding method capable of injecting the semi-molten metal in a state of a laminar flow is more suitable than the die casting because of its high viscosity in the presence of a solid phase in the melt.

However, even if the semi-molten metal injection molding method is applied to the thick-wall article, filling and gas defects, shrinkage cavity, etc, cannot be avoided in the thick-wall parts of the molded article when setting the same molding conditions as in the case of producing a conventional relatively thin-wall molded article. Thus, for the injection molding process it is difficult to mold the thick molded article with high quality.

SUMMARY OF THE INVENTION

An object of the present invention is to provide a method of injection molding a semi-molten metal to a thick molded article with high quality by properly setting the molding conditions, thereby, obtaining a thick product free from internal defects, The present invention is intended to produce a thick molded article, having thickness of not less than 5.0 mm in an are of 50% or more of a product portion corresponding to the cavity, is produced by injection molding a semi-molten metal of a metal material, at a temperature of not more than a liquidus temperature of the metal material, into a cavity of a mold through a product gate. To this end, the present invention, the solid fraction in the molten metal is set to 10% or more.

A solid fraction in the semi-molten melt lower than 10% causes the thick product to have internal defects such as gas defects in the thick portion. The high solid fraction can be easily adjusted by the temperature of the semi-molten metal held in the injector.

Preferably, the solid fraction of the semi-molten metal to be injected may be set within a range of 40 to 80%. As the solid fraction is higher than 40% the thick product may reduce in internal defects, while the solid fraction larger than 80% causes a reduction in fluidity in the semi-molten metal, resulting in filling defects into the mold cavity. The solid fraction in the above defined range can most effectively prevents both the filling defects and internal defects to obtain a high quality of the thick molded article.

In the invention, a sectional area of a product gate portion of the thick molded article corresponding to the product gate may preferably be set to not less than 0.1 times a sectional area of the product portion in the vicinity of the product gate. Each of the sectional areas means an area in a sectional plane perpendicular to a flow direction of the semi-molten melt.

The sectional area of a product gate portion smaller than 0.1 times a sectional area of the product portion, disturbance is liable to occur in the semi-molten melt flow into the cavity from the gate, which leads to entrapment of gas babbles in the metal. Therefore, the sectional area of a product gate portion of the thick molded article corresponding to the product gate is set to not less than 0.1 times a sectional area in the vicinity of the product gate in the product portion.

In the invention, the velocity Vg ($mm/^s$) of the semi-molten metal when passing through the product gate, a sectional area Sg ($mm^2$) of the product gate portion of the thick molded article and a volume Vp ($mm^3$) of the product portion are set so as to satisfy the following relationships:

$$Vg \leqq 8.0\times10^4; \text{ and,}$$

$$Vg\times Sg/Vp \geqq 10.$$

That is, the product gate velocity Vg mm/s of the semi-molten melt is set to not more than $8.0\times10^4$ because the velocity Vg $mm/^s$ of larger than $8.0\times10^4$ is liable to cause disturbance in the metal flow. When the product gate velocity Vg mm/s of the semi-molten metal is too small and Vg×Sg/Vp becomes smaller than 10, the semi-molten melt is solidified until the semi-molten melt is perfectly filled to the cavity, resulting in filling defects in the molded product. Therefore, the molding conditions are required to satisfy the relationships of $Vg\times Sg/Vp \geqq 10$. This feature in the invention makes it possible to obtain the thick molded article of higher quality, effectively preventing filling defects in the molded products.

In the invention, at least one product gate is connected to a portion of the cavity corresponding to the maximum thickness portion of the product portion of the thick molded article, continuing to apply a pressure to the maximum thickness portion to be finally solidified in the product portion until the maximum thickness portion is solidified. Therefore, shrinkage pores in the metal can be prevented from forming in the product portion having maximum thickness.

In the invention, a mold temperature in the vicinity of the product gate is set to be higher by 50° C. or more than that of the cavity.

This construction makes it possible to prevent the semi-molten melt filled in the product gate from solidifying earlier than the semi-molten melt filled in the cavity, and to apply a pressure securely to the semi-molten melt filled in the cavity. Consequently, it is possible to securely inhibit the shrinkage cavity from forming at the production portion of the thick molded article.

In the invention, the heating means is provided in the vicinity of the product gate, and the mold temperature in the vicinity of the product gate is set to be higher by 50° C. or more than that of the cavity by using the heating means. This construction makes it possible to easily control the mold temperature in the vicinity of the product gate to a temperature higher than that of the cavity.

In the invention, the solid fraction of the semi-molten melt filled in the product gate is set to a value which is 10% higher than that of the semi-molten melt filled in the 7.

According to this invention, since the semi-molten melt filled in the product gate is solidified earlier than that filled in the cavity, it is possible to effectively inhibit shrinkage cavity from forming at the product portion of the thick molded article.

The invention is an invention of a semi-molten metal injection molding apparatus of producing a thick molded article whose thickness is not less than 5.0 mm in the portion of not less than 50% of a product portion corresponding to the cavity, by injecting a semi-molten melt of a metal material, in a semi-melting state at a temperature of not more than a liquidus temperature of the metal material, into a cavity of a mold through a product gate.

In this invention, the solid fraction of the semi-molten melt is set to not less than 10%. In the invention, the solid fraction of the semi-molten melt is set within a range of 40 to 80%.

The sectional area of a product gate portion of the thick molded article corresponding to the product gate is set to not less than 0.1 times a sectional area in the vicinity of the product gate in the product portion.

In the invention, wherein a product gate velocity Vg mm/s of the semi-molten melt, a sectional area Sg $mm^2$ of the product gate portion of the thick molded article and a volume Vp $mm^3$ of the product portion are set so as to satisfy the following relationships:

$$Vg>8.0\times10^4 \text{ and } Vg\times Sg/Vp\geqq 10.$$

In the invention, at least one product gate is connected with a portion corresponding to the maximum thickness portion of the product portion of the thick molded article in the cavity.

In the invention, the mold temperature in the vicinity of the product gate is set to be higher by 50° C. or more than that of the cavity In the invention, the heating means is provided in the vicinity of the product gate, and the mold temperature in the vicinity of the product gate is set to be higher by 50° C. or more than that of the cavity by using the heating.

In the invention, the solid fraction of the semi-molten melt filled in the product gate is set to a value which is 10% higher than that of the semi-molten melt filled in the cavity.

DESCRIPTION OF THE PREFERRED EMBODIMENTS

Figure 1:
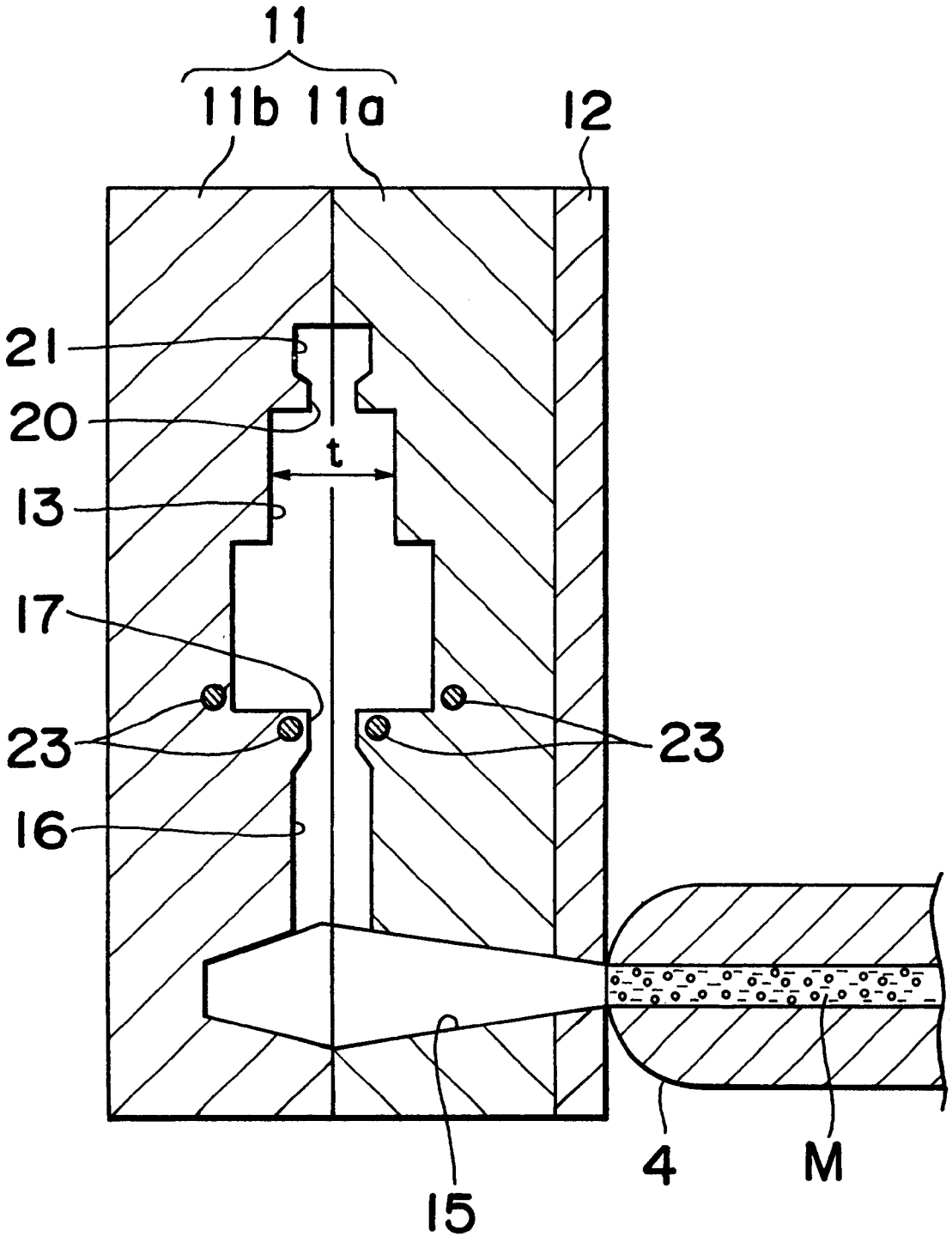
FIG. 1 is shows a sectional view of a mold used in in an apparatus for semi-molten metal injection molding according to an embodiment of the present invention.
Figure 2:
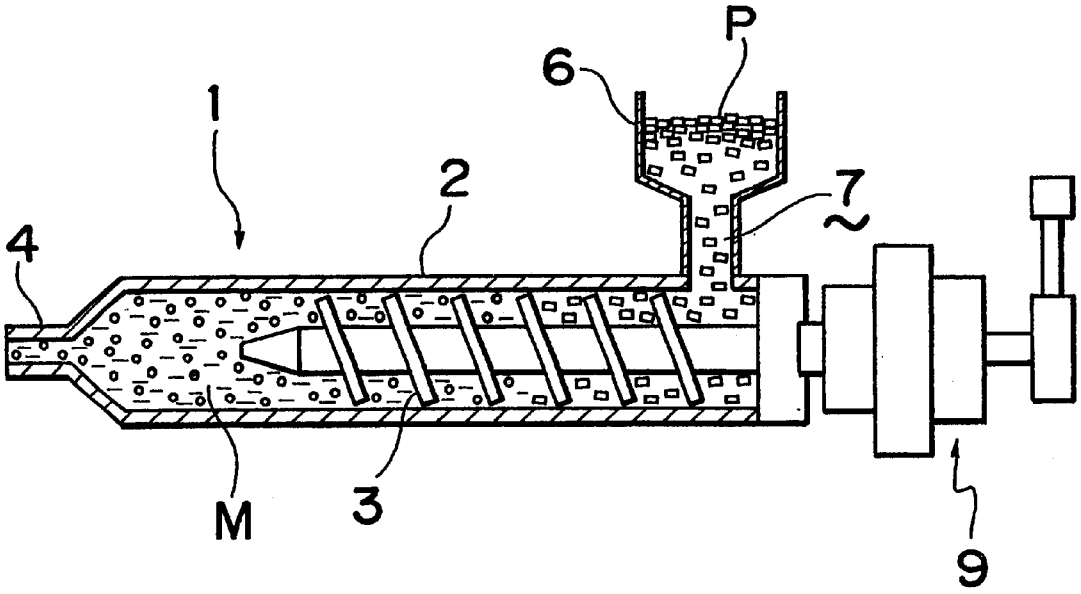
FIG. 2 is a sectional view showing an injector used in the semi-molten metal injection molding apparatus.

Embodiments of the present invention will be described below with reference to the accompanying drawings. FIG. 1 and FIG. 2 respectively show an apparatus for injection molding a semi-molten metal according to an embodiment of the present invention, where the apparatus comprises an injecting mold with a thick gap of a cavity 13 into which a semi-molten melt M of a metal material is molded, and an injector 1 which heats and holds the metal material in a semi-melting state at a temperature of not more than a liquidus temperature of the metal material which is injected into the cavity 1 of the mold 11, thereby to form a thick molded article. A portion of the thick molded article corresponding to the cavity 13 is called the product portion. The term "thick molded article" used in this specification refers to a molded article having thickness of not less than 5.0 mm in 50% or more of area of the product portion.

The injector 1 has an injection cylinder 2 as shown in FIG. 2, the injection cylinder 2 having a screw 3 disposed therein rotatably and movably back and forth. The injection cylinder 2 also has a nozzle 4 provided integrally at the tip thereof.

Provided above a rear end of the injection cylinder 2 is a hopper 6 for charging a starting material. The hopper 6 is connected to the injection cylinder 2 via an argon atmospheric chamber 7 that is filled with argon gas. Thus the starting material is charged into the hopper and put in an argon atmosphere where the material is prevented from being oxidized. In this embodiment, pellets P in the form of shavings of a magnesium alloy are used as the starting material.

Disposed around the injection cylinder 2 and the nozzle 4 is a heater (not shown), so that the pellets P fed from the hopper 6 into the injection cylinder 2 are molten by the heater while being agitated by the screw 3, thereby turning into semi-molten melt M. The semi-molten melt M is heated and held in a semi-melting state at a temperature not higher than the liquidus temperature of an alloy such as magnesium alloy, comprising a mixture of solid fraction and liquid fraction therein. The solid fraction which is defined as a percentage proportion of an amount of the solid phase in the total amount of the melt) may be set within a range of 40 to 80%. On one hand, the solid fraction smaller than 40% tends to cause internal defects. On the other hand, the solid fraction larger than 80% the semi-molten melt to reduce in fluidity in the mold cavity, resulting in filling defects in the thick molded article.

In this embodiment, a plurality of heaters are disposed in an axial direction around the injection cylinder 2, thereby separately controlling the temperatures of the semi-molten melt M in a plurality of divided heating sections inside the injection cylinder 2 including the nozzle 4 in the axial direction.

Disposed at the backside of the injection cylinder 2 is a high-speed injecting actuator 9 which push the screw 3 the semi-molten melt M to eject through the nozzle 4. As the pellets P or semi-molten melt M is pushed forward by the screw 3, the pressure causes the screw 3 to retreat (retreat of the screw 3 is assisted by hydraulic pressure because the molten magnesium has viscosity lower than that of a resin material) and, when the screw has retreated by a predetermined distance (a distance corresponding to the amount of semi-molten melt M ejected in one shot of injection), the injecting actuator 9 pushes the screw 3 forward to the former position.

A front end of the nozzle 4 is connected to the bottom inlet of the mold 11 as shown in FIG. 1. The mold 11 comprises a front mold 11*a* that is fixed on a fixed plate 12 and a movable half 11*b* that mates with the front mold 11*a* and departs therefrom, thereby forming the cavity 13, that has a substantially the same configuration as the product portion of the thick molded article, between the front mold 11*a* and the movable half 11*b* when the mold is closed. Thus, an average clearance between the front mold 11*a* and the movable half 11*b* in the cavity 13 corresponds to the average thickness t of the product portion of the thick molded article.

Disposed between the nozzle 4 and the cavity 13 are a spool 15, a runner 16 and a product gate 17 in sequence from the nozzle 4 side. This product gate 17 is connected with the portion corresponding to the maximum thickness portion of the product portion of the thick-wall product in the cavity 13. On the other hand, the mold 11 also has an overflow groove 21 via an overflow gate 20 provided on the opposite side (upper side) of the product gate 17 with respect to the cavity 13, so that air in the cavity 13 can escape to the overflow groove 21.

Both the product gate 17 and the overflow gate 20 are throttled in the direction of thickness of the product portion of the thick molded article, Thus the clearance between the front mold 11*a* and the movable half 11*b* in the overflow gate 20, namely thickness to of the overflow gate portion corresponding to the overflow gate 20 of the thick molded article and the clearance between the front mold 11*a* and the movable half 11*b* in the product gate 17, namely thickness to of the product gate portion corresponding to the product gate 17 of the thick molded article are set to a value smaller than that in the case of the product portion.

The sectional area Sg (cut in a direction perpendicular to a flow direction of the semi-molten melt M) of a product gate portion of the thick molded article corresponding to the product gate is set to not less than 0.1 times a sectional area Sp (cut in a the same direction as that of the product gate portion) in the vicinity of the product gate 17 in the product portion. That is, when the sectional area Sg of the product gate portion of the thick molded article is smaller than 0.1 times the sectional area Sp in the vicinity of the product gate 17 in the product portion, when the semi-molten melt M flows into the cavity 13 from the product gate 17, disturbance is liable to occur in the semi-molten melt flow, which leads to entrapment of a gas.

The apparatus has such a construction as the semi-molten melt M is forced by the high-speed injection mechanism 9 through the nozzle 4, the spool 15, the runner 16 and the product gate 17, into the cavity 13, thereby to form the thick molded article. The semi-molten melt velocity at the product gate Vg mm/s (speed at the product gate 17), a sectional area Sg (unit: $mm^2$) of the product gate portion of the thick molded article and a volume Vp (unit: $mm^3$) of the product portion are set so as to satisfy the following relationships:

$$Vg<8.0\times10^4;\ \text{and,}$$

$$Vg\times Sg/Vp>10.$$

The product gate velocity Vg mm/s of the semi-molten melt is set to not more than $8.0\times10^4$ because the product gate velocity Vg mm/s of larger than $8.0\times10^4$ mm/s (80 m/s) is liable to cause disturbance. When the product gate velocity Vg mm/s of the semi-molten melt is too small and Vg×Sg/Vp becomes smaller than 10, the semi-molten melt is solidified to cause filling defects. Therefore, it is necessary to satisfy the relationship:

$$Vg\times sg/Vp\geqq10.$$

Furthermore, the solid fraction of the semi-molten melt M filled in the product gate 17 is set to a value which is 10% larger than that of the semi-molten melt M filled in the cavity 13. That is, the temperature of the portion at the rear end side of the injection cylinder 2 (portion to be filled in the product gate 17) out of the amount of the semi-molten melt M ejected in one shot of injection is set to a value higher than that of the portion at the nozzle side (portion to be filled in the cavity 13) by heat control of a plurality of heaters in the injector 1.

In the vicinity of the product gate 17, four heaters 23, 23 . . . as a heating means are disposed and each heater 23 is formed to control the mold temperature (about 250° ) in the vicinity of the product gate 17 to be higher by 50° C. or more than the mold temperature (about 200° C.) of the cavity 17.

The thick molded article is made by using the semi-molten metal injection molding apparatus in the following procedure. First, pellets P of an magnesium alloy are charged into the hopper 6, and the screw 3 rotates to push the pellets P that have been fed into the injection cylinder 2 forward to the nozzle 4 while kneading. At the same time, the pellets P are heated by the heater to turn into the semi-molten melt M in a semi-melting state, while the screw 3 retreats by the pressure generated in this process and the hydraulic pressure.

When the screw 3 has retreated by a predetermined distance, the screw 3 stops rotating, then the high-speed injection mechanism 9 is operated to advance the screw 3. This procedure causes the semi-molten melt M in a semi-melting state to be forced out of the nozzle 4 and fill the cavity 13 of the mold 11. At this time, since the solid fraction of the semi-molten melt M is set within a range of 40 to 80% and the sectional area Sg of the product gate portion of the thick molded article is set to not less than 0.1 times the sectional area Sp in the vicinity of the product gate 17 in the product portion and, furthermore, the product gate velocity Vg of the semi-molten melt M is set so as to satisfy the relationships of $Vg\leqq8.0\times10^4$ and $Vg\times Sg/Vp\geqq10$, it is possible to control filling defects of the semi-molten melt M and to inhibit gas entrapment.

Since the solid fraction of the semi-molten melt M filled in the product gate 17 is set to a value which is 10% or more lower than that of the semi-molten melt M filled in the cavity 13 and, at the same time, the mold temperature in the vicinity of the product gate 17 is set to be higher by 50° C. or more than that of the cavity 13, it is made possible to prevent the semi-molten melt M filled in the product gate 17 from solidifying earlier than the semi-molten melt M filled in the cavity 13, and to apply a pressure securely to the semi-molten melt M filled in the cavity 13. Moreover, since the product gate 17 is connected with the portion corresponding to the maximum thickness portion of the product portion of the wall-thick molded article in the cavity 13, it is possible to apply a pressure until the maximum wall-thick portion is solidified to the maximum wall-thick portion as a final solidification portion in the product portion.

After the semi-molten melt M in a mold 11 is completely solidified by cooling, the mold 11 is opened to release the thick molded article from the mold, and unnecessary portions other than the product portion of the thick molded article are cut off. The product portion of the thick molded article thus obtained does not include any gas defects and shrinkage cavity therein and has good quality.

In the above embodiments, the solid fraction of the semi-molten melt M was set within a range of 40 to 80%, but may be set within 10%. That is, when the solid fraction of the semi-molten melt M is smaller than 10%, internal defects such as gas defects occur in the thick molded article. Therefore, when the solid fraction is not less than 10%, a thick molded article of high quality is obtained without causing any problem.

The semi-molten metal injection molding apparatus according to the embodiment described above is preferable for making the thick molded article made of a magnesium alloy, though it can be applied also to other metals, particularly aluminum alloy.

In the above embodiments, the mold temperature in the vicinity of the product gate 17 was controlled to a value higher than that of the cavity 13 by providing four heaters 23, 23, . . . in the vicinity of the product gate 17. The mold temperature in the vicinity of the product gate 17 may also be controlled by providing an oil passage (heating means) for passing through high-temperature oil in the vicinity of the product gate 17 of the mold 11.

EXAMPLES

The following Examples further illustrate the present invention in detail.

First, three kinds of magnesium alloys (alloy A, alloy B and alloy C) with different chemical compositions, as shown in Table 1, were prepared.

TABLE 1

| | Chemical composition (% by weight) | | | | | | |
|---|---|---|---|---|---|---|---|
| | Al | Zn | Mn | Fe | Ni | Cu | Mg |
| Alloy A | 6.2 | 0.9 | 0.23 | 0.003 | 0.0008 | 0.001 | bal. |
| Alloy B | 7.1 | 0.8 | 0.20 | 0.002 | 0.0008 | 0.002 | bal. |
| Alloy C | 8.9 | 0.7 | 0.24 | 0.003 | 0.0008 | 0.001 | bal. |

Subsequently, thick molded articles were produced by using the above alloy A, alloy B and alloy C and the density of the product portion of each of thick molded articles was measured. It was then examined how the value obtained by dividing this density by a theoretical density of each alloy (referred to as a relative density) changes with the solid fraction of the semi-molten melt. The more this relative density becomes smaller, the more defects occur in the product portion of the thick molded article. At this time, the product portion of the thick molded article had a size of 100 cm in length×30 mm in width×8 mm in thickness and a product gate was provided at one end side of the product portion in the longitudinal direction. The ratio of the sectional area of the product gate in the thick molded article to the sectional area of the product portion (fixed to 240 $mm^2$ independently of the distance to the product gate), namely Sg/Sp was set to 0.2, while the product gate velocity Vg of the semi-molten melt was set to $4.5\times10^4$ mm/s (45 m/s) and the value of Vg (mm/s)×Sg ($mm^2$)/Vp ($mm^3$) was set to 80 ($s^{-1}$).

Figure 3:
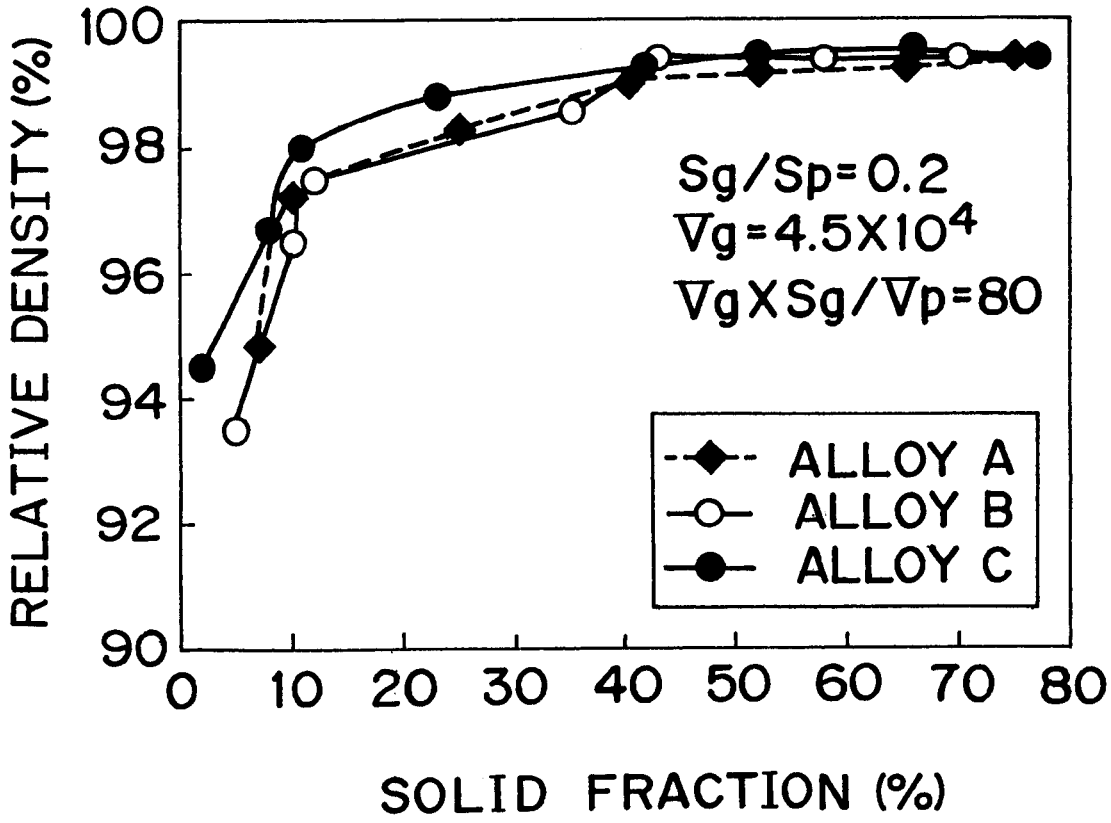
FIG. 3 is a graph showing a relationship between solid fraction in the semi-molten melt and relative density of a product portion of the thick molded article.

The measurement results of the above relative density are shown in FIG. 3. As is apparent from these results, when the solid fraction is smaller than 10%, the relative density is rapidly lowered, whereas, when the solid fraction is larger than 40%, the relative density is stable and good.

Figure 4:
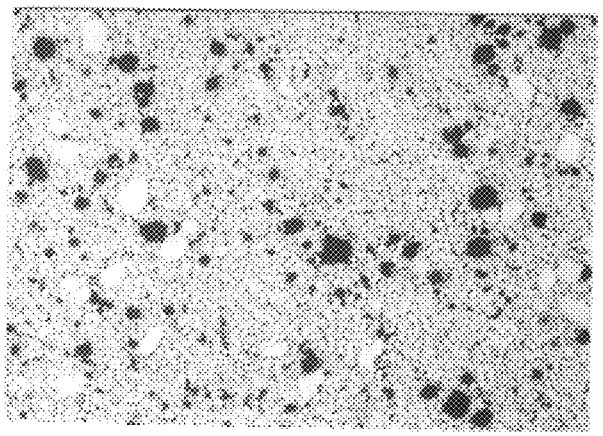
FIG. 4 is an optical micrograph showing a microstructure of the product portion of the thick molded article produced by using .an alloy C wherein the solid fraction is set to 2%.
Figure 5:
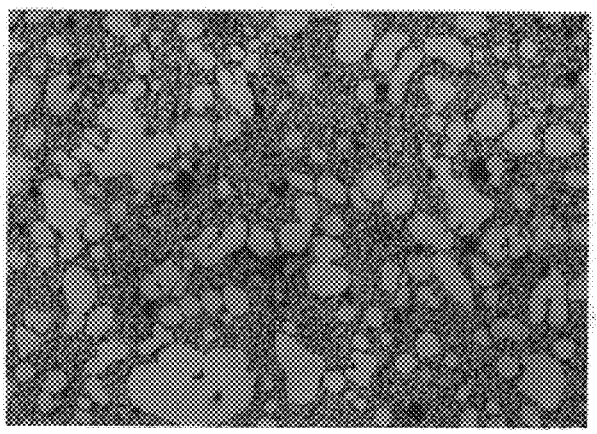
FIG. 5 is an optical micrograph showing a microstructure of the product portion of the thick molded article produced by using an alloy C wherein the solid fraction is set to 11%.
Figure 6:
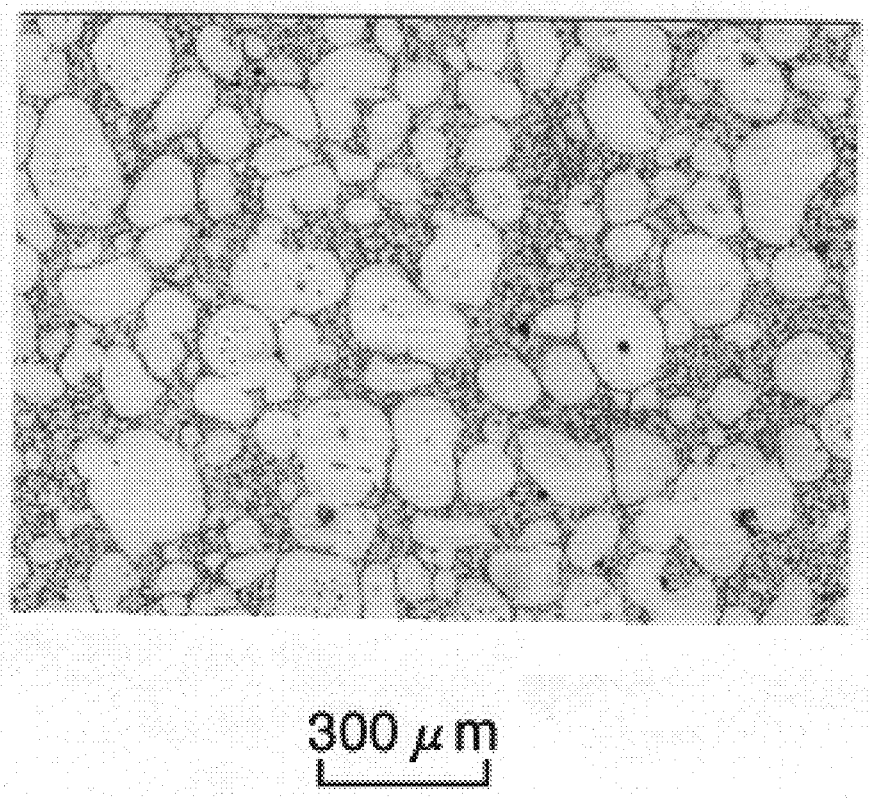
FIG. 6 is an optical micrograph showing a microstructure of the product portion of the thick molded article produced by using an alloy C wherein the solid fraction is set to 52%.

Next, the microstructure of the product portion of the thick molded article produced by using the alloy C was examined in an optical microscopy. In the articles, the solid fractions were set to 2%, 11% and 52%. The results are shown in FIG. 4 to FIG. 6, respectively. As is apparent from the results, when the solid phase separation is 2%, defects (black granular portion) are present in large quantity and, when the solid phase separation is 52%, defects are hardly present. That is, these results correspond well to the measurement results about the about relative density. In these micrographs, the white or gray granular portion was a portion which was a solid phase in a semi-melting state.

It was then examined whether the relative density of the product portion of the thick molded article produced by using the alloy C changes with the ratio Sg/Sp of the sectional area of the product gate portion in the thick molded article to the sectional area of the product portion. At this time, the solid fraction was set to 23% and the product gate velocity Vg of the semi-molten melt was set to $4.5\times10^4$ mm/s (45 m/s).

Figure 7:
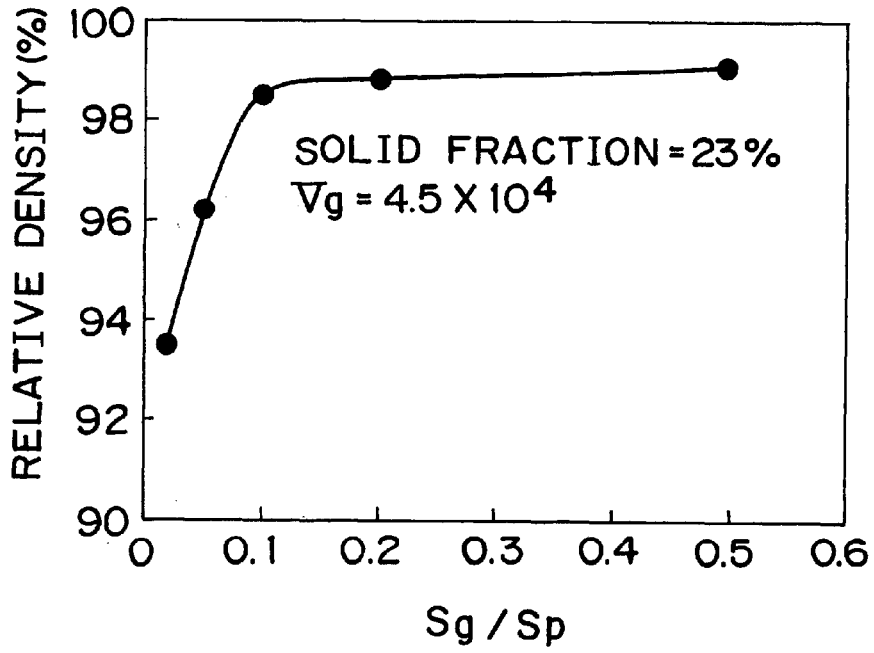
FIG. 7 is a graph showing a relationship between the ratio of a sectional area of the product gate portion to a sectional area of the product portion, i.e. Sg/S in the thick molded article and the relative density of the product portion.

The measurement results of the above relative density are shown in FIG. 7. As is apparent from the results, when the ratio Sg/Sp is smaller than 0.1, the relative density is drastically lowered and internal defects increase.

Furthermore, it was then examined whether the relative density of the product portion of the thick molded articles produced by using the alloy A and alloy C changes with the product gate velocity Vg of the semi-molten melt. At this time, the ratio Sg/Sp was set to 0.2 and Vg×Sg/Vp was set to a value of not less than 10 ($s^{-1}$).

Figure 8:
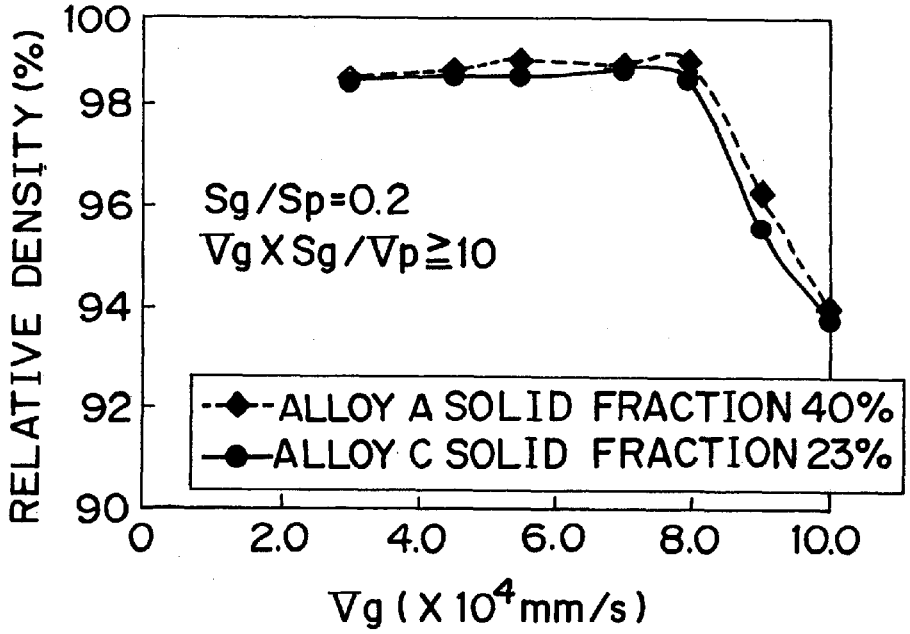
FIG. 8 is a graph showing a relationship between the product gate velocity Vg and the relative density of the product portion of the thick molded article.

The measurement results of the above relative density are shown in FIG. 8. As is apparent from the results, when Vg is larger than $8.0\times10^4$ mm/s (80 m/s), the relative density is lowered and internal defects increase.

Next, it was examined whether the semi-molten melt is solidified to cause filling defects by changing the value of Vg×Sg/Vp when producing the thick molded articles using the alloy A and alloy C. At this time, Sg/Sp was set to 0.2 and Vg was set to a value of not more than $8.0\times10^4$ mm/s (80 m/s). The solid fraction of the semi=molten melt was set to 40% in the case of the alloy A, while it was set to 52% in the case of the alloy C.

TABLE 2

| Alloy | Solid fraction | Vg × Sg/Vp | filling defects |
|---|---|---|---|
| A | 40% | 5 | recognized |
| | | 10 | None |
| | | 30 | None |
| | | 70 | None |
| | | 150 | None |
| C | 52% | 5 | recognized |
| | | 10 | None |
| | | 30 | None |
| | | 70 | None |
| | | 150 | None |

Figure 9:
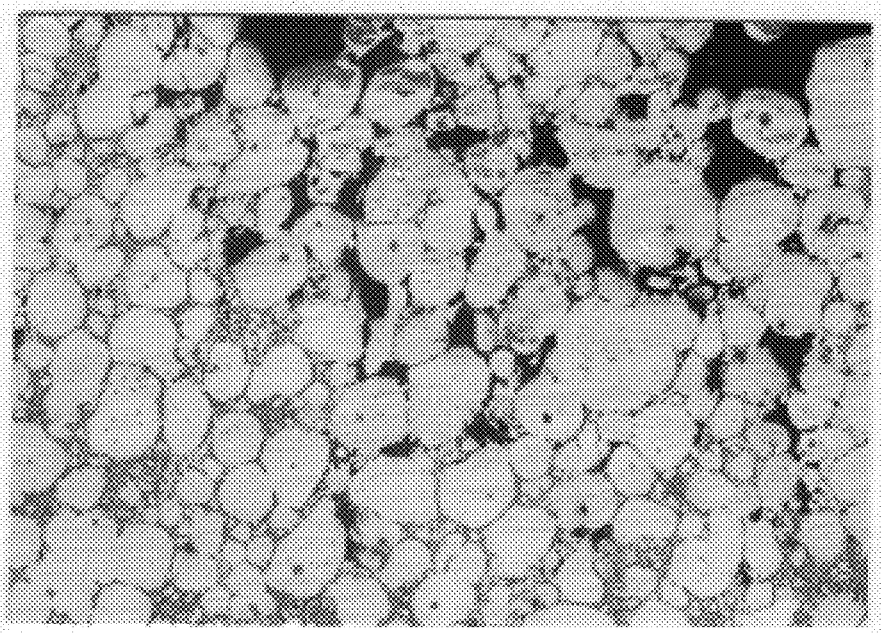
FIG. 9 is an optical micrograph showing a microstructure of the product portion of the thick molded article produced by using an alloy C wherein Vg×Sg/Vp is set to 5.

The results of are shown in Table 2. As is apparent from these results, when Vg×Sg/Vp is not less tan 10, filling defects of the semi-molten melt do not occur. Then, the microstructure of the product portion of the thick molded article produced by using the alloy C under the conditions of Vg×Sg/Vp of 5 was examined by an optical microscope (magnification: about 50). As is shown from FIG. 9, comparatively large defects (black portion) are caused by filling defects of the semi-molten melt.

Figure 10:
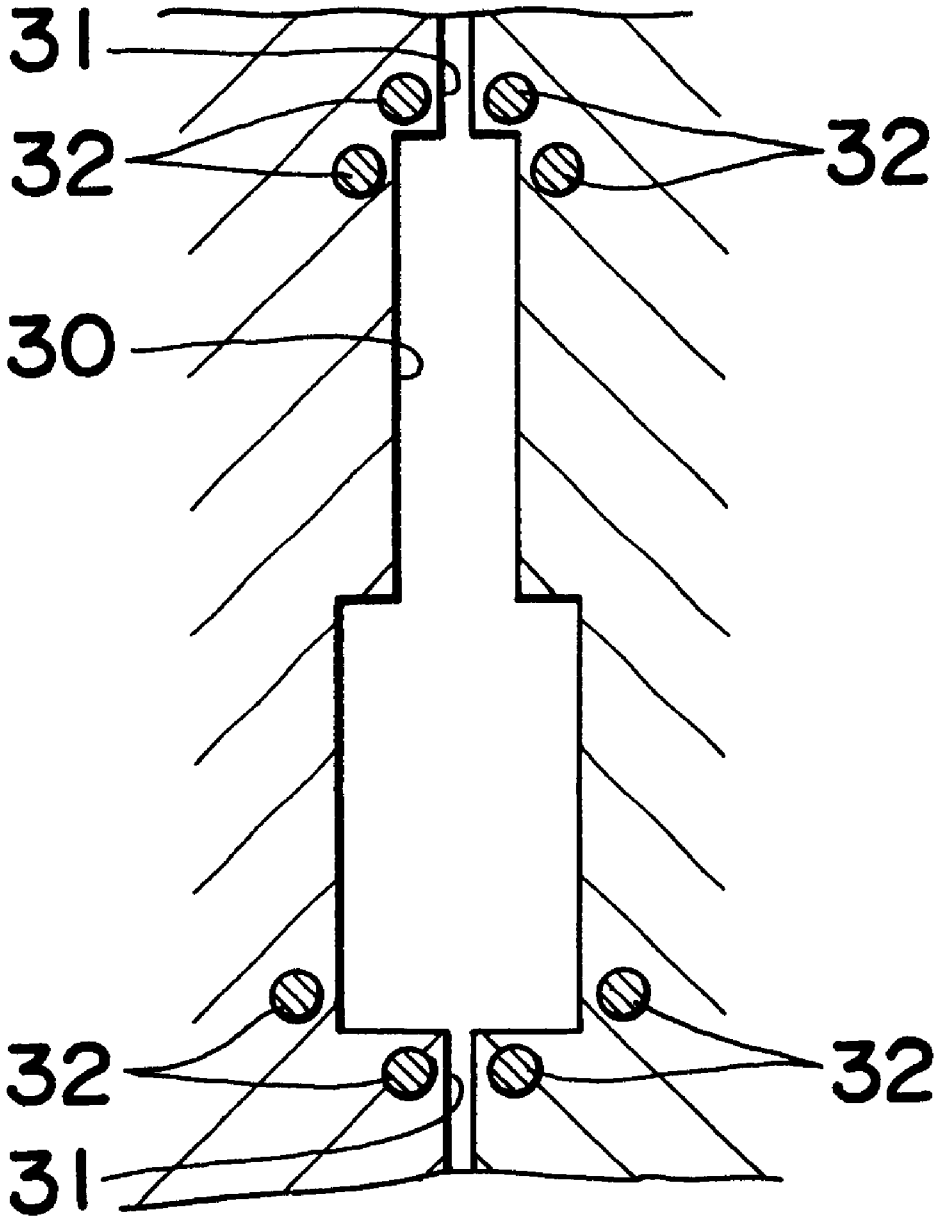
FIG. 10 is a schematic diagram showing cavity configuration of a mold used in a relative density measuring test.

As shown in FIG. 10, a cavity 30 of the mold was formed so as to make it possible to produce a thick molded article having a thick-wall portion and a thin-wall portion, and two product gates 31, 31 were provided at the thick-wall side and thin-wall side of the product portion of the thick molded article, respectively. After four heaters 32, 32 . . . were respectively provided in the vicinity of each product gate 31, a thick molded article was produced by using only one product gate 31 (other product gate are in a state of being opened). At this time, the solid fraction of the semi-molten melt filled in the cavity 30 was set to 30%, while Sg/Sp, Vg and Vg×Sg/Vp were set to 0.2, $5.0\times10^4$ and 65, respectively. It was then examined how the relative density of the product portion of the thick molded article changes with the product gate 31 to be used (thick-wall side or thin-wall side of the product portion), presence/absence of heating (on heating, the mold temperature in the vicinity of the product gate 31 is controlled to a temperature which is 50° C. or more higher than that in the vicinity of the cavity 30) of the semi-molten melt filled in the product gate 31 by each heater 32 in the vicinity of the product gate 31 to be used, and the solid phase separation of the semi-molten melt filled in the product gate 31. The solid fraction of the semi-molten melt filled in the product gate 31 was set to 18% (10% lower than that of the semi-molten melt filled in the cavity 30) and 30%, respectively.

The measurement results of the above relative density are shown in Table 3.

TABLE 3

| Product gate to be used | Heating | Solid fraction in product gate | Relative density |
|---|---|---|---|
| Thick-wall side | Heated | 18 | 98.2 |
| | | 30 | 97.9 |
| | not heated | 18 | 97.8 |
| | | 30 | 98.0 |
| Thin-wall side | heated | 18 | 98.0 |
| | | 30 | 98.2 |
| | Not heated | 18 | 98.0 |
| | | 30 | 97.2 |

As is apparent from these results, the internal quality of the product portion is liable to be improved by providing the product gate at the thick-wall side, heating the semi-molten melt filled in the product gate using the heater, and setting the solid fraction of the semi-molten melt filled in the product gate to 18%.

According to the present invention, as described above, when producing the thick molded article by injecting semi-molten melt in a semi-melting state into the cavity of the mold, the solid fraction is set to not less than 10%, thus making it possible to easily improve the quality of the thick molded article.

In the present invention, the solid fraction is set within a range of 40 to 80%, thus making it possible to further improve the quality of the thick molded article with inhibiting poor filling of the semi-molten melt.

The sectional area of the product gate portion of the thick molded article corresponding to the product gate is set to not less than 0.1 times the sectional area in the vicinity of the product gate in the product portion.

According to the invention, the product gate velocity Vg mm/s of the semi-molten melt, a sectional area Sg $mm^2$ of the product gate portion of the thick molded article and a volume Vp $mm^3$ of the product portion are set so as to satisfy the following relationships: $Vg\leqq8.0\times10^4$ and $Vg\times Sg/Vp\geqq10$, thus improving the quality of the thick molded article with further inhibiting effectively poor filling of the semi-molten melt.

According to the invention, at least one product gate is connected with a portion corresponding to the maximum thickness portion of the product portion of the thick molded article in the cavity, thus making it possible to inhibit shrinkage cavity from forming at the maximum thickness portion.

In the invention, the mold temperature in the vicinity of the product gate is set to be higher by 50° C. or more than that of the cavity, thus securely inhibiting shrinkage cavity from forming at the product portion of the thick molded article.

In the invention, the heating means is provided in the vicinity of the product gate, and the mold temperature in the vicinity of the product gate is set to be higher by 50° C. or more than that of the cavity by using the heating means, thus easily controlling the mold temperature in the vicinity of the product gate to a temperature higher than that of the cavity.

The solid fraction of the semi-molten melt filled in the product gate is set to a value which is 10% higher than that of the semi-molten melt filled in the cavity, thus further inhibiting shrinkage cavity effectively from forming at the product portion of the thick molded article.

What is claimed is:

1. A method of injection molding a semi-molten metal in a mold cavity to produce a thick molded article having thickness of not less that 5.0 mm in 50% or more of an area of a product portion corresponding to the mold cavity, wherein the semi-molten melt of a metal material is injected in a semi-melting state at a temperature of not more than a liquidus temperature of the metal material into the cavity of a mold through a product gate by using an injector which has an injection cylinder provided with a nozzle of a lower inner diameter than an inner diameter of the injection cylinder;

the method comprising the steps of heating the material in the cylinder while being agitating by a screw into the semi-molten metal in which a solid fraction in the semi-molten melt is set to not less than 10%, pushing the semi-molten metal by means of the screw from the cylinder through the nozzle and injecting the semi-molten metal through the gate into the mold cavity, wherein a velocity Vg (mm/s) of the semi-molten melt passing through the product gate, a sectional area Sg ($mm^2$) of the product gate portion of the thick molded article and a volume Vp ($mm^3$) of the product portion are set so as to satisfy the following relationships:

$Vg<8.0\times10^4$; and, $Vg\times Sg/Vp\geqq10$, a mold temperature in the vicinity of the product gate is set to be higher by 50° C. or more than that at the cavity; and the solid fraction in the semi-molten melt filled in the product gate is set to be lower by 10% or more than that in the semi-molten melt filled in the cavity.

2. The method according to claim 1, wherein the solid fraction in the semi-molten melt is set within a range of 40 to 80%.

3. The method according to claim 1, wherein a sectional area of a product gate portion of the thick molded article corresponding to the product gate is set to not less than 0.1 times a sectional area of a product portion in the vicinity of the product gate.

4. The method according to claim 1, wherein at least one product gate is connected to a portion corresponding to the maximum thick portion of the product portion of the thick molded article in the cavity.

5. The method according to claim 1, wherein a heating means is provided in the vicinity of the product gate, to set the mold temperature in the vicinity of the product gate and at the cavity.

* * * * *